United States Patent [19]

Bolton et al.

[11] Patent Number: 4,856,295

[45] Date of Patent: Aug. 15, 1989

[54] SECURITY LOCK FOR A ROOM AIR CONDITIONER

[75] Inventors: Theodore S. Bolton, Liverpool; Richard D. Lang, Chittenango, both of N.Y.

[73] Assignee: Carrier Corporation, Syracuse, N.Y.

[21] Appl. No.: 153,690

[22] Filed: Feb. 8, 1988

[51] Int. Cl.[4] ..... F25D 23/12

[52] U.S. Cl. ..... 62/263; 62/298

[58] Field of Search ..... 312/101, 333, 311, 319; 62/298; 206/560; 292/145, 149, 137; 220/210, 324

[56] References Cited

U.S. PATENT DOCUMENTS

| | | | |
|---|---|---|---|
| 889,484 | 6/1908 | Parker | 292/149 |
| 1,885,186 | 11/1932 | Defoy | 312/333 X |
| 2,431,178 | 11/1947 | Keane | 292/149 |
| 3,199,938 | 8/1965 | Vouk | 312/333 |
| 3,944,266 | 3/1976 | Weaver | 292/149 X |
| 4,341,166 | 7/1982 | Cantley | 312/333 X |

*Primary Examiner*—Joseph Falk

*Attorney, Agent, or Firm*—Dana F. Bigelow

[57] ABSTRACT

A sliding lock mechanism is mounted behind the front wall of the chassis, and associated openings are provided in the front and side walls of the chassis to respectively provide operator access to the lock mechanism and allow it to be reciprocally moved so as to extend through the side wall opening to engage a flange surface of the cabinet to thereby lock the chassis in its installed position. A fastener is also provided in the front wall opening to secure the locking member in its engaged position.

14 Claims, 1 Drawing Sheet

SECURITY LOCK FOR A ROOM AIR CONDITIONER

BACKGROUND OF THE INVENTION

This invention relates generally to room air conditioners and, more particularly, to a locking device for securing a slide out chassis to a cabinet mounted in a wall opening.

A room air conditioner is a self-contained unit comprising a chassis which is slideably disposed within a cabinet, with the inner and outer ends of the chassis being exposed to the room and ambient air, respectively. The cabinet is mounted in a wall opening such as a window and is secured therein by fasteners or the like. The chassis is then installed into the cabinet by sliding it in from the inner side thereof. Unless the chassis is then secured to the cabinet in some fashion, it is possible to gain entry into the conditioned space by pushing inwardly on the outer end of the chassis until it slides out of the cabinet.

A common approach for securing the chassis within the cabinet is to install one or more fastening devices, such as a screw or the like, through the side wall of the chassis and into the cabinet. For example, in the case of top discharge units, it is a simple procedure to install a screw on either side of the discharge opening prior to installing the inner grill cover. The applicants have found, however, that with some designs, the side walls of the chassis are not accessible for this procedure. For example, with a side discharge unit having air diverting louvers mounted in the discharge opening, it is difficult, if not impossible, to drive a screw through the side wall of the chassis.

It is therefore an object of the present invention to provide an improved method and apparatus for securing a room air conditioner chassis to its cabinet.

Another object of the present invention is the provision in a side discharge room air conditioner for effectively securing the chassis into the cabinet.

Still another object of the present invention is the provision for a simple and effective method and apparatus for securing a room air conditioner from outside access.

These objects and other features and advantages become more readily apparent upon reference to the following description when taken in conjunction with the appended drawings.

SUMMARY OF THE INVENTION

Briefly, in accordance with one aspect of the invention, a locking device is installed within the indoor corner of the chassis, just behind the front face and adjacent to the side wall thereof. Openings are provided in both the front and side walls, with the front opening providing operator access to the locking device and the side opening allowing for a reciprocating portion of the locking device to project therethrough so as to engage a flange portion of the cabinet to thereby prevent the chassis from being slid inwardly. The reciprocating motion is accomplished by the operator's movement of the reciprocating portion along the front cover opening, and a fastening device is provided to finally secure the reciprocating portion and prevent it from being moved from the locked position.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
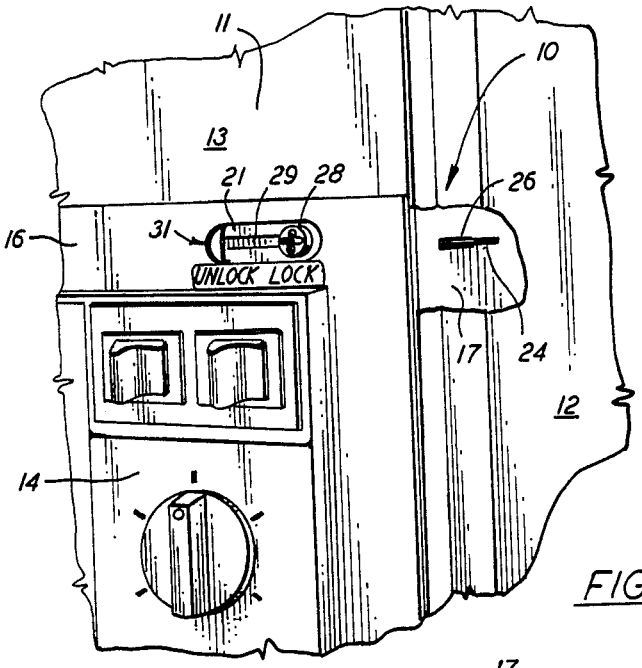
FIG. 1 is a perspective view of the control panel portion as broken away from a room air conditioner and having the present invention embodied therein.

Referring now to the drawings, the invention is shown generally at 10 as applied to a room air conditioner 11 which is installed in an outer wall opening in a conventional manner. In such an installation, the outer cover, or wrapper 12 is mounted, and attached by appropriate fasteners, within the wall opening, and the air conditioning chassis 13 is slideably disposed within the wrapper 12 in such a way as to facilitate the repair and maintenance of the system by way of simply sliding the chassis 13 inwardly toward the room so as to thereby gain access to the various components. Since, without any kind of locking means provided, this can be accomplished from the outside to thereby gain access to the room, it is desirable to provide some kind of locking device which secures the chassis 13 in the wrapper 12.

In the front face of the chassis 13 there is provided a control panel 14 with a surrounding escutcheon 16. The escutcheon and the entire front face of the chassis is covered by a grill (not shown) which can be easily removed for access to the chassis. The grill includes a door to cover the control panel 14. Typically, the door will be closed most of the time so as to protect the control panel 14 from dust and the like but will be easily opened to operate the controls whenever desired.

As part of the chassis 13 structure, an upstanding partition side wall 17 is provided to form the side boundary thereof, and a generally horizontally disposed deck structure 18, is a U-shaped portion 19 which includes front and top walls 21 and 22, respectively. The deck 18, which serves as the bottom boundary of the discharge duct and the top boundary of the control box, also facilitates the installation of a lock in accordance with the present invention.

Mounted within the deck U-shaped portion 19, in an L-shaped lock member 23 having a tab 24 which is extendable through a hole 26 in the partition side wall 17 so as to engage a flange portion 27 of the wrapper 12 to thereby lock the chassis 13 in place and prevent it from being moved inwardly into the room Near the other end of the lock member 23, a screw 28 is provided to secure the locking member 23 against the front wall 21 of the deck 18. The screw 28 passes through the front wall 21 by way of a slot 29 which allows the screw 28 to horizontally reciprocate with the lock member 23 so as to move between the lock and unlocked positions. Access to the screw 28 is provided by an elongate opening 31 formed in the escutcheon 16 as shown in FIG. 1.

Figure 2:
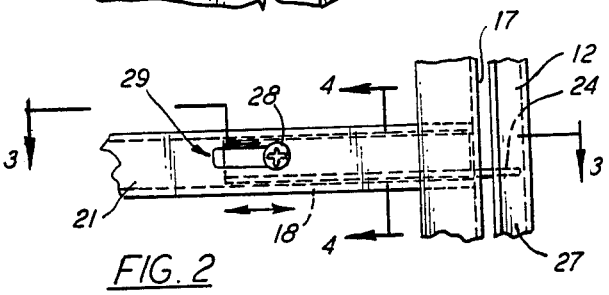
FIG. 2 is a front view of the locking portion thereof.
Figure 3:
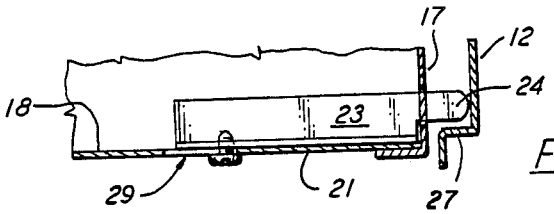
FIG. 3 is a top sectional view thereof as seen along lines 3—3 of FIG. 2.
Figure 4:
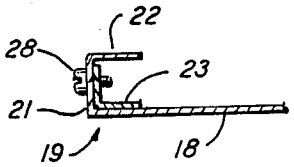
FIG. 4 is a side sectional view thereof as seen along lines 4—4 of FIG. 2.

In operation, when the room air conditioner 11 is intalled, the chassis 13 is contained within the wrapper 12 and the lock member 23 is in the position as shown in FIGS. 2 and 3. When in this position, the chassis 13 is prevented from being moved inwardly so as to be removed from the wrapper 12. When it is desirable to gain access to the chassis for repair or maintenance purposes, the front grille is removed and the escutcheon 16, together with the opening 31 and the screw 28 is exposed. The screw 28 is loosened and slid, along with the lock member 23, to the left so as to move the tab 24 away from the wrapper flange 27 and thereby permit the chassis 13 to be slid out from the wrapper 12. When the repair has been completed, the chassis is slid back into the wrapper 12, the screw 28 and the attached lock member 23 are slid to the right so as to thereby engage the tab 24 with the flange portion 27, and the screw 28 is then tightened. The grill is then replaced to cover up the escutcheon 16 and the opening 31. While the invention has been described in terms of a particular structure, it should be understood that other forms may be used while remaining within the scope of the present invention. For example, although the locking member 23 has been mounted to a deck structure 18 and passes through the partition side wall 17, it may just as well be mounted to another member and pass through a top or bottom wall, for example, of the chassis.

What is claimed is:

1. In a room air condtioning system of the type having a chassis with a compressor and evaporator and condenser coils mounted thereon, and having front and side wall structures and being slideably disposed within a rectangular cabinet which is adapted for installation into a wall opening an improved security lock apparatus comprising:

a side opening formed in the chassis side wall structure;

a front elongate opening formed in the chassis front wall structure adjacent said side opening; and a lock member slideably mounted between said side and front openings and being accessible from said front elongate opening to be selectively positionable by sliding between a retracted position and an extended position wherein, when the chassis is positioned within the cabinet to such a position that said lock member is aligned with a selected portion of the cabinet, a portion of said lock member extends through said said opening to engage said selected portion of the cabinet to thereby lock the chassis into the cabinet.

2. A securing apparatus as set forth in claim 1 and including a fastener with a portion disposed through said front elongate opening and being threadably attached to said lock member and with a head portion engaging the chassis front wall structure such that when said fastener is screwed down it acts to secure said lock member from sliding movement.

3. A securing apparatus as set forth in claim 1 wherein said front wall structure is U-shaped in form, with parallel side legs on opposite sides of said lock member and being interconnected by an intermediate wall and with said intermediate wall having said front elongate openings.

4. A securing apparatus as set forth in claim 2 and including a front plate mounted adjacent said front wall structure and having an elongate horizontally disposed opening formed therein for said fastener to be slideably and accessibly disposed.

5. A securing apparatus as set forth in claim 1 wherein said lock member is L-shaped in form with one of its walls being disposed substantially parallel with the chassis front wall structure.

6. A securing apparatus as set forth in claim 1 wherein said lock member portion which extends through said side opening is substantially planar in form and is disposed in a plane substantially normal to said front wall structure.

7. In a room air conditioner of the type having a cabinet mounted in an opening of an outside wall and containing a chassis slideably mounted therein and having a compressor, an evaporator, and condenser coils mounted thereon and having at least one side wall, an improved security lock apparatus comprising:

an opening formed in said at least one side wall of said chassis;

a lock member slideably mounted on said chassis, adjacent said opening, and having an engaging portion extending through said opening when moved to an extended position; and a flange extending from the cabinet toward the chassis and being so disposed relative to said lock member as to be engaged by said engaging portion of said lock member when said lock member is in its extended position such that said chassis is prevented from being withdrawn from the cabinet.

8. A security lock apparatus as set forth in claim 7 wherein the chassis includes a front wall portion and further wherein said lock member is disposed behind said front wall portion.

9. A security lock apparatus as set forth in claim 8 wherein said front wall portion includes an opening for access to said lock member.

10. A security lock apparatus as set forth in claim 7 and including fastener means for securing said lock member from sliding movement.

11. A security lock apparatus as set forth in claim 9 wherein said front wall opening is elongate is form.

12. A security lock apparatus as set forth in claim 8 and including a face plate member disposed in front of said front wall portion and having an elongate opening formed therein to provide access to said lock member.

13. A security lock apparatus as set forth in claim 8 wherein said front wall portion is U-shaped in form with a pair of horizontally disposed leg elements extending rearwardly on either side of said lock member and being interconnected by an intermediate member extending normally therebetween.

14. In a room air conditioner of the type having a chassis with a compressor and evaporator and condenser coils mounted thereon, and having front and side walls and being slideably disposed within a rectangular wrapper which is adapted for installation into a wall opening an improved locking device comprising:

a U-shaped lock mount structure disposed behind the chassis front wall and comprising a pair of parallel legs extending substantially normally to the chassis side wall and being interconnected by an intermediate leg having a mount elongate opening formed therein adjacent said chassis front wall;

a side opening formed in the chassis side wall;

a front elongate opening formed in the chassis front wall to provide access to said elongate opening in said lock mount structure;

a lock member slideably mounted in said lock mount structure and being accessible from said front elongate opening to be selectively positionable by sliding between a retracted position within said mount structure and an extended position therein, wherein, when the chassis is positioned within the cabinet to such a position that said lock member is aligned with a flange portion of the cabinet a portion of such lock member extends through said side wall opening to engage said flange portion of the cabinet to thereby lock the chassis in the cabinet; and a fastener partially disposed and reciprocally movable within said mount elongate opening and being attached to said lock member for selectively securing said lock member to said mount structure to prevent it from sliding.

* * * * *